United States Patent [19]

Little et al.

[11] 4,003,189

[45] Jan. 18, 1977

[54] BUNDLING MECHANISM

[75] Inventors: Keith W. Little, Georgetown; Barry C. Millar, Islington, both of Canada

[73] Assignee: Bundy Corporation, Detroit, Mich.

[22] Filed: Apr. 18, 1975

[21] Appl. No.: 569,483

[52] U.S. Cl. ..... 53/198 R; 100/7; 156/481; 156/492

[51] Int. Cl.[2] ..... B65B 13/02; B65B 27/10

[58] Field of Search ..... 53/3, 198 R, 139.3; 100/7, 8; 156/212, 215, 475, 481, 486, 492

[56] References Cited

UNITED STATES PATENTS

| | | | |
|---|---|---|---|
| 1,464,332 | 8/1923 | Pease | 53/198 R X |
| 2,379,935 | 7/1945 | Seiferth et al. | 53/198 R X |
| 2,780,044 | 2/1957 | Dewyer | 53/198 R |
| 3,221,641 | 12/1965 | Adams et al. | 53/198 R X |
| 3,262,246 | 7/1966 | Olsen et al. | 53/198 R |

*Primary Examiner*—Robert Louis Spruill
*Assistant Examiner*—John Sipos
*Attorney, Agent, or Firm*—Harness, Dickey & Pierce

[57] ABSTRACT

A bundling mechanism collects tubes from a tube processing machine, holds a selected quantity of the tubes in a bundle-like shape and wraps the bundles with lengths of adhesive backed tape. The bundles are indexed between first and second wrapping stations with one-half of the wrap being accomplished at each station. The end of a roll of tape extends tangentially between the bundles at the two stations. A special cutter-wrapper moves between the wrapping stations to cut the tape and wrap the cut tape ends around adjacent portions of the bundles.

16 Claims, 14 Drawing Figures

BUNDLING MECHANISM

SUMMARY OF THE INVENTION

The bundling mechanism of the present invention collects elongated workpieces (such as tubes) which are delivered to it one at a time by processing machinery. When a desired number of workpieces have been collected, the mechanism indexes the workpieces through first and second wrapping stations. The workpieces are held by clamps in the desired bundle shape at each station while they are wrapped with adhesive backed tape at spaced locations along their length. A tape cutter-wrapper is positioned between the first and second wrapping stations. The actuation of the cutter-wrapper cuts the tape and applies a partial wrap of tape around the bundles at both the first and second wrapping stations. The wrap which is made at each station extends slightly greater than 180° around the bundle. The tape which is wrapped at the first station is connected to the tape supply. Thus, when a bundle at the first wrapping station is moved to the second wrapping station, it draws a new length of tape off the supply roll and presents the new tape length to the cutter-wrapper where it will be cut and wrapped partially around the bundles during the next actuation of the cutter-wrapper. Accordingly, a complete wrap of tape around a given bundle requires two actuations of the cutter-wrapper; one with that bundle at the first wrapping station and a second after that bundle has been indexed to the second wrapping station.

According to the present invention, it is not necessary to orbit a roll of tape about the workpiece or to move any other device 360° about a workpiece in one operation. The roll of tape is maintained in a fixed location with an end length of the tape extending between the first and second wrapping stations tangentially to the bundles at said stations. The actuation of the cutter-wrapper cuts the tape end midway between the stations and immediately thereafter the severed portions of the tape end are wrapped around the adjacent portions of the bundles at the first and second stations. One side of a given bundle is adjacent the cutter-wrapper at the first station while the opposite side of that bundle is adjacent the cutter-wrapper when it is moved to the second wrapping station. The movement of a bundle between the first and second wrapping stations performs the added function of drawing fresh tape from the tape roll.

The present invention also eliminates any need to tumble, or rotate a bundle as it is moved between stations. Neither is any human intervention required to assist in the wrapping or bundling function. The mechanism produces a reliable wrap in which the ends of the tape are overlapped on each other, thereby holding the workpieces in a secure manner. It is not necessary to have access to the ends of the bundles in order to produce the wrap, but wraps may be made at any desired location along the length of a bundle of extreme length. Thus, the invention lends itself to use with long tubes and other long workpieces.

A highly practical and reliable embodiment of the invention has been constructed in which all movements are accomplished by the reciprocation of pneumatic cylinders. This mechanism is easily maintained, is of a relatively reasonable cost and is highly reliable in operation.

DETAILED DESCRIPTION OF THE ILLUSTRATED EMBODIMENT

Figure 1:
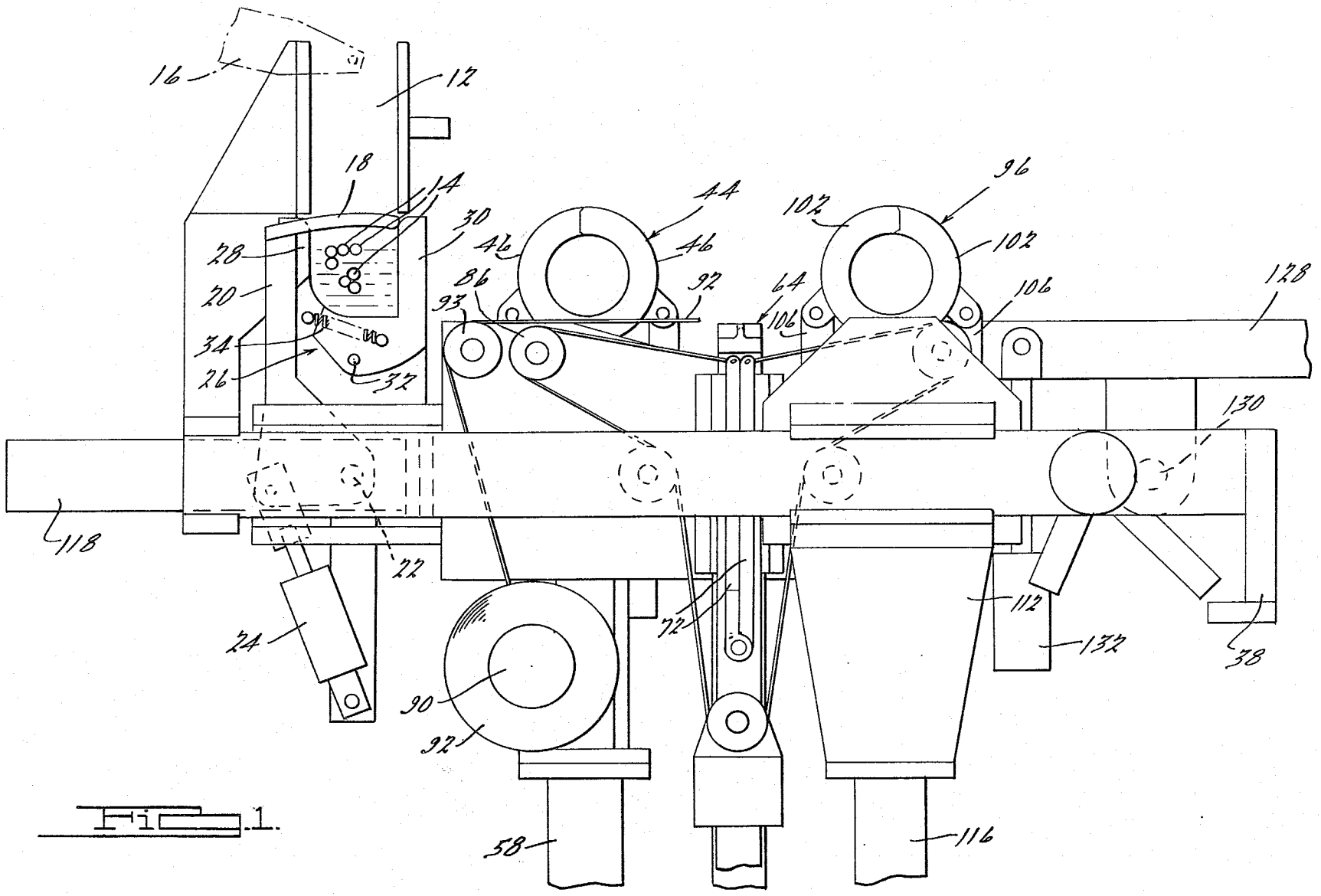
FIG. 1 is a fragmentary side elevational view of a bundling mechanism constructed in accordance with the principles of the present invention.

FIG. 1 depicts a chute 12 into which lengths of tubing 14 are dropped one at a time by aligned grab clamps 16. The tubes 14 are oriented perpendicular to the plane of the sheet of FIG. 1. That is, end views of tubes 14 are presented in FIG. 1 wherein a gate 18 is shown positioned at the bottom of the chute 12 so that tubes 14 delivered to the chute will come to rest on the gate. The gate 18 is mounted on the end of a lever 20 that is pivoted at 22 for oscillation by a pneumatic cylinder 24. The actuation of the cylinder 24 moves the gate 18 in a lefthand or counterclockwise direction, opening the bottom of the chute 12 to a tube collecting cradle 26. The cradle 26 is upwardly open and has a sidewall 28 on one side thereof and a lever 30 forming a second sidewall operable to confine tubes between it and the first sidewall 28. The lever 30 is pivoted to the cradle 26 at 32 and is normally held in the position illustrated in FIG. 1 by means of a coil spring 34.

Figure 2:
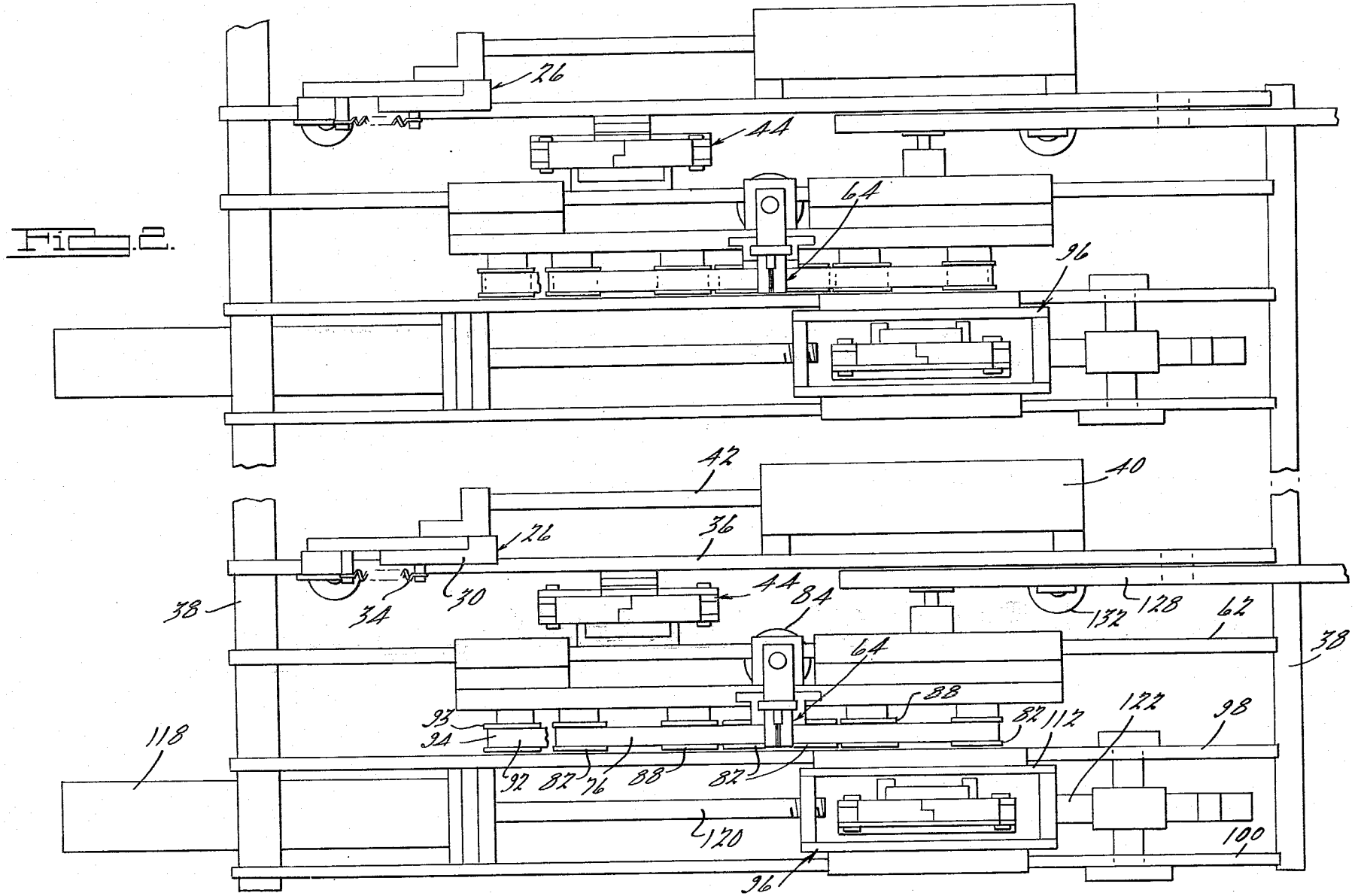
FIG. 2 is a plan view, with parts removed, of the structure illustrated in FIG. 1.

The cradle 26 and the structure described hereinafter are located in a selected position along the length of the tubes 14 to produce a single wrap. In actual usage, a plurality of mechanisms of the present invention are positioned at spaced locations along the lengths of the tubes 14 to be bundled and wrapped. The exact number of such mechanisms will depend upon the number of wraps of tape desired. A pair of the mechanisms is shown in FIG. 2 to illustrate their relative orientation. It will be appreciated that additional mechanisms of the present invention could be used between the two mechanisms illustrated in FIG. 2.

The cradle 26 is mounted for reciprocation on a way 36 supported on a framework 38. The cradle 26 is capable of being moved back and forth on the way 36 by a pneumatic cylinder 40 which is connected to the cradle 26 by its piston rod 42. The purpose of the cradle 26 is to collect a predetermined quantity of tubes 14 and then transfer such tubes to a fixed tube clamp 44. The desired quantity is determined by the use of a counter (not illustrated) which is actuated each time a tube 14 is dropped down the chute 12.

Figure 5:
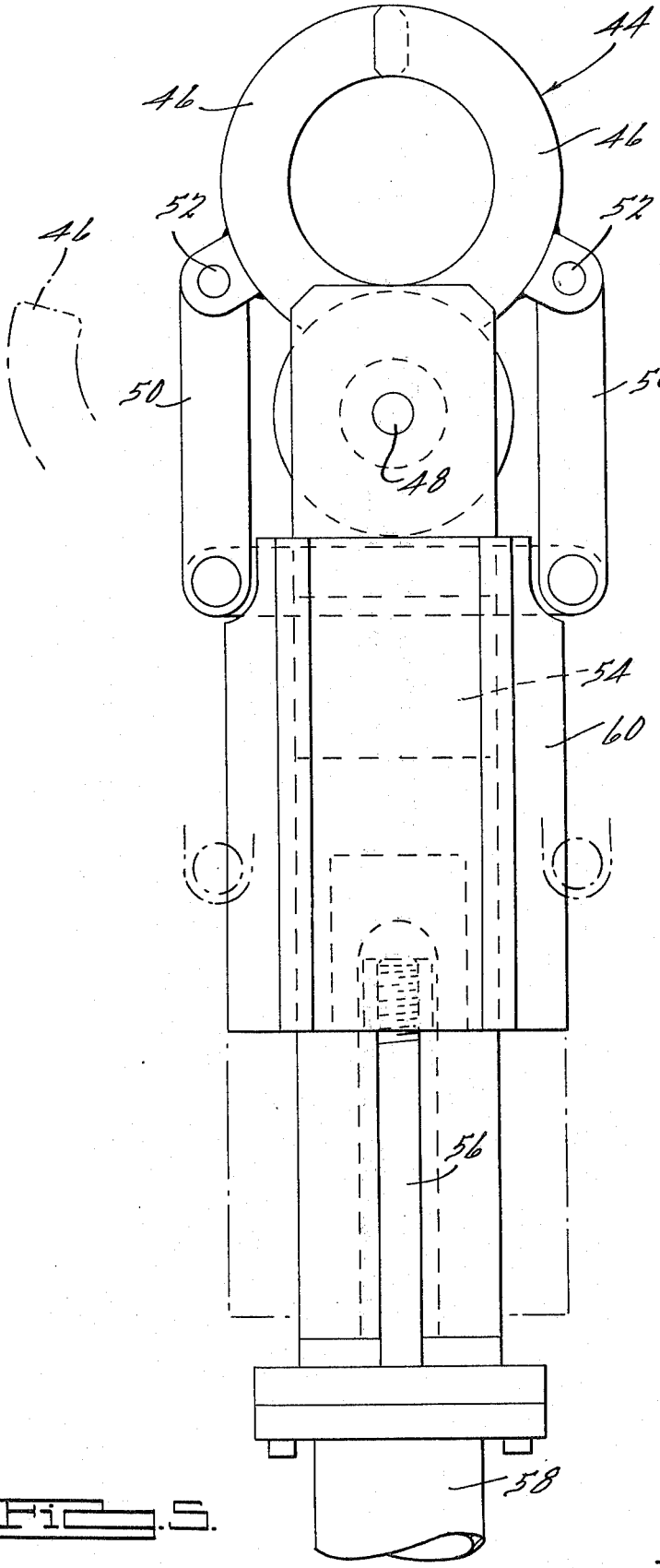
FIG. 5 is an enlarged elevational view of another portion of the structure illustrated in FIGS. 1 and 2.
Figure 6:
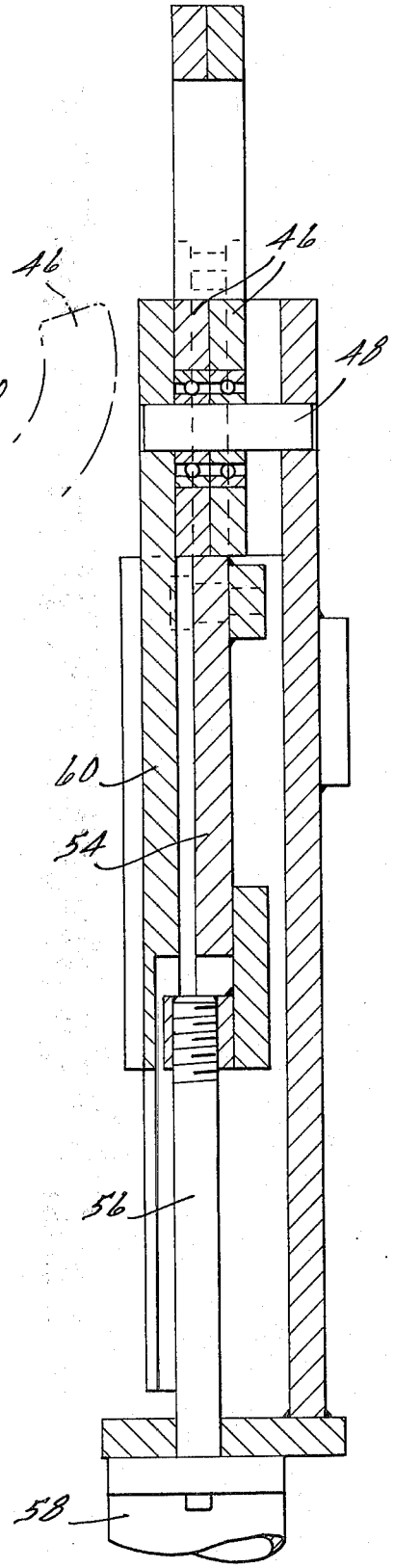
FIG. 6 is a vertical sectional view of the structure illustrated in FIG. 5.
Figure 7:
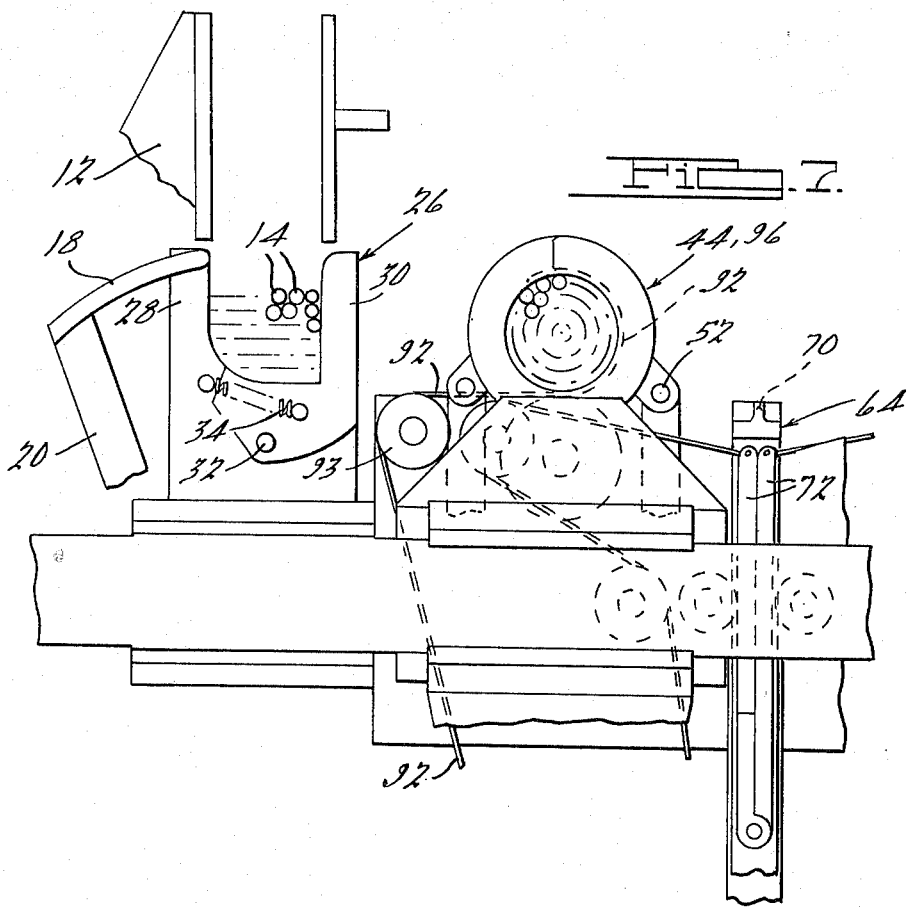
FIGS. 7 through 14 are fragmentary side elevational views on a reduced scale of the mechanism illustrated in FIGS. 1 and 2 depicting the positions of the various parts of the mechanism during successive stages in the bundle forming and wrapping sequence.
Figure 8:
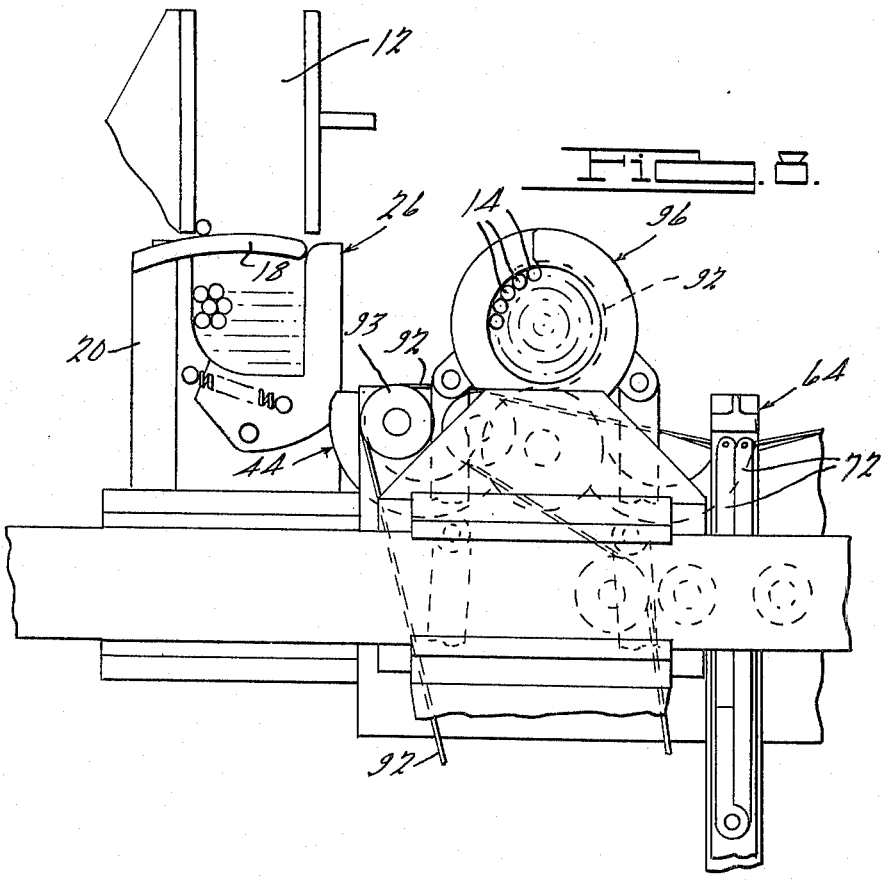

The fixed tube clamp 44 forms a quantity of tubes 14 into the desired bundle shape and holds these tubes in what may be described as the first wrapping station. The bundle of tubes 14 is shaped by a pair of arcuate jaws 46 of the fixed tube clamp 44. The jaws 46 are pivoted on a pivot pin 48. These parts, as well as the other details of the fixed tube clamp 44 are illustrated in FIGS. 5 and 6. As shown in FIG. 5, a pair of short links 50 are pivotally connected to the jaws 46 at their upper ends. The lower ends of the links 50 are pivoted to an actuating plate 54 which is connected at its lower end to a piston rod 56. The piston rod 56 is actuated by a pneumatic cylinder 58 which depends from the lower end of a housing 60. The housing 60 also serves to guide the plate 54 for vertical reciprocatory movement. The housing 60 is secured to and between the way 36 and a second way 62, parallel to the way 36 (FIG. 2).

Figure 3:
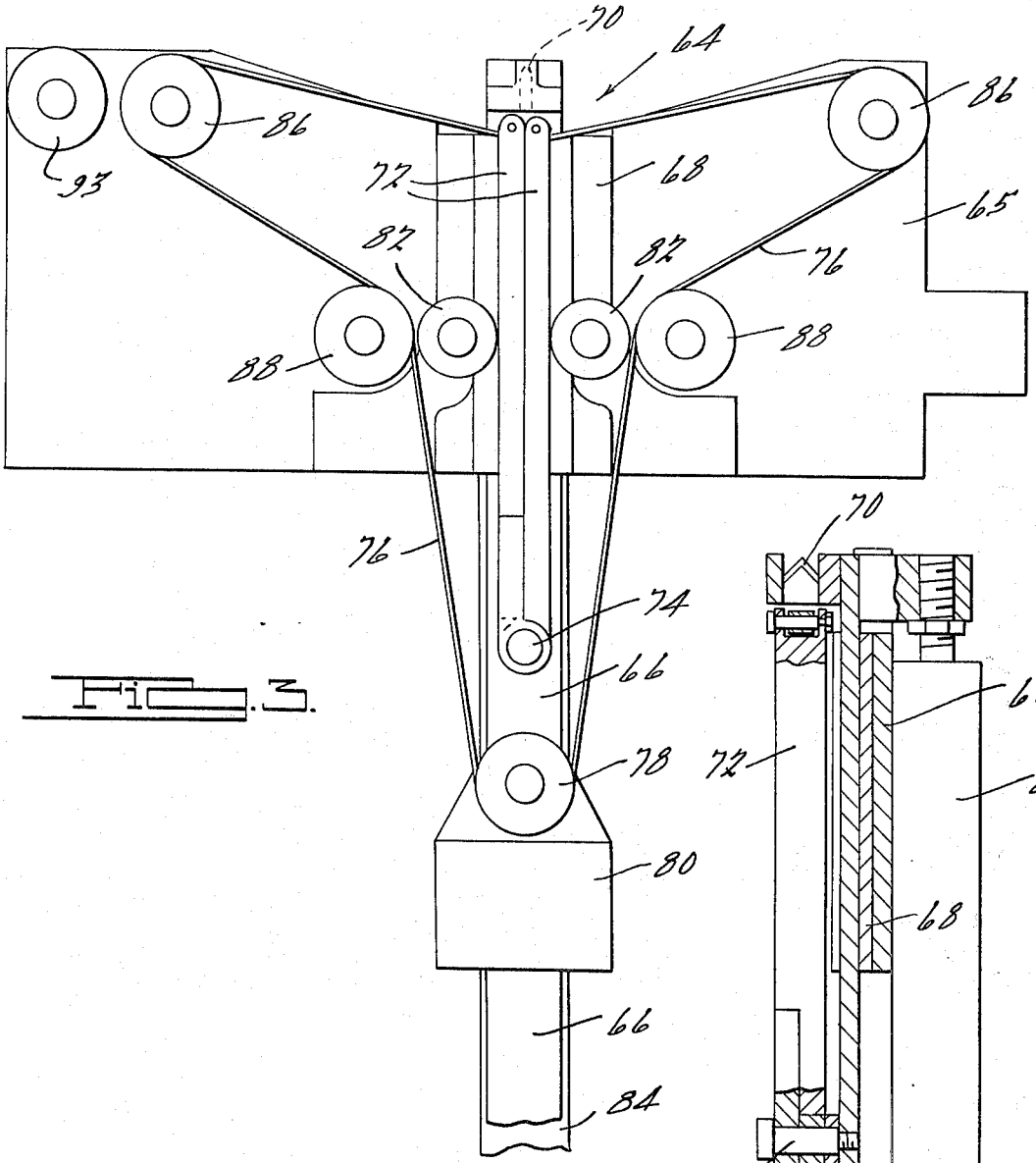
FIG. 3 is an enlarged elevational view of a portion of the structure illustrated in FIGS. 1 and 2.
Figure 4:
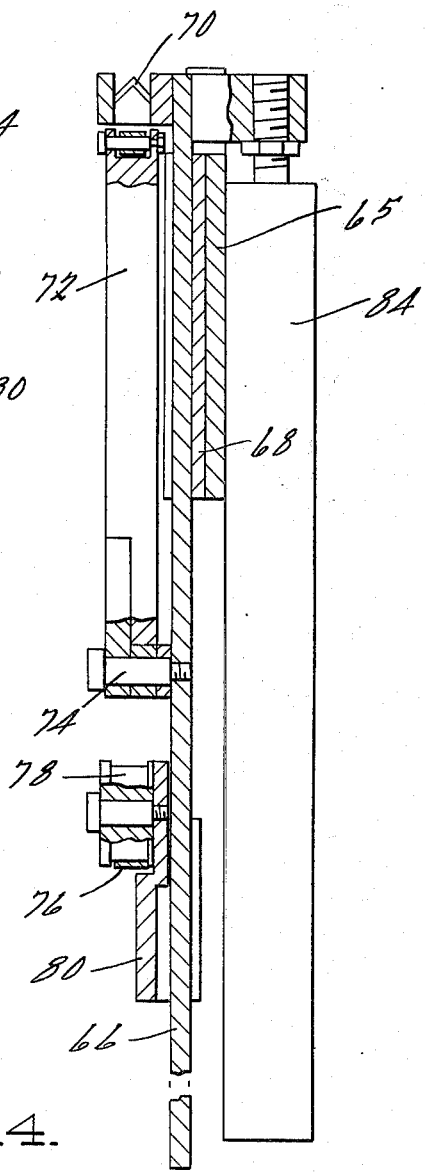
FIG. 4 is a vertical sectional view of the structure shown in FIG. 3.

Mounted in a fixed but adjustable position on the way 62 is a cutter-wrapper assembly 64. The details of the construction of the cutter-wrapper 64 are shown in FIGS. 3 and 4. The cutter-wrapper 64 includes a support member 65 which is fastened to the way 62. A vertically elongated carrier bar 66 is guided for vertical reciprocation by a guide member 68 mounted on the support member 65. The bar 66 carries a razor sharp knife 70 at its upper end. A pair of long pivoted arms 72 are also carried by the bar 66 and are pivoted on a pivot pin 74 fastened to the bar. A flexible spring steel strap 76 has its opposite ends connected to the upper ends of the two arms 72. The mid area of the strap 76 passes under a pulley-like roller 78 rotatably supported on a free hanging weight 80, resulting in opposed outward forces being applied to the upper ends of the arms 72. The upper ends of the arms 72 are normally prevented from moving apart, however, by a pair of rollers 82 mounted on the support 65 and engageable with the outer sides of the arms 72. Vertical movement of the bar 66 is accomplished by a pneumatic cylinder 84. During this movement the weight 80 is free to move relative to the bar 66 and relative to the guide 68 and support member 65. The strap 76 passes over the insides of a pair of lower idler rollers 88 positioned outwardly of the rollers 82 and around the outer sides of a pair of upper idler rollers 86. The rollers 82, 86 and 88 are all rotatably mounted on the support 65. As will be apparent hereinafter, when the carrier bar 66 has been elevated to a sufficient height (in which the pivot pin 74 approaches a line drawn between the axes of the rollers 82), the upper ends of the arms 72 will be moved apart under the force applied thereto by the strap 76. During the upward movement of the bar 66, the knife 70 will have severed a length of adhesive backed tape 92 and the portions of the strap 76 adjacent the upper ends of the arms 72 will thereafter press the cut ends of the tape 92 against the tube bundles.

A tape roll supporting journal 90 is fixedly positioned below the cutter-wrapper 64 for rotatably supporting a roll of the tape 92. The tape 92 passes upwardly from the journal 90 around an idler roller 93 mounted on the support 65, and thence horizontally in a plane lying substantially tangentially to a tube bundle at the first wrapping station. The bundle of tubes 14 in the first wrapping position is adapted to be moved to a second wrapping position by a movable bundle clamp 96. The movable bundle clamp 96 is supported for horizontal reciprocation on a pair of ways 98 and 100 (FIG. 2) parallel to ways 36 and 62. The movable bundle clamp 96 is illustrated in the second wrapping positions in FIGS. 1 and 2. Except for the portions thereof which provide its sliding support on the ways 98 and 100, the construction of the movable bundle clamp 98 is identical to the construction of the fixed bundle clamp illustrated in FIGS. 3 and 4. Such structure includes a pair of arcuate jaws 102 which are adapted to be opened and closed by a pair of links 106 operated by a pneumatic cylinder 116 in a manner similar to the actuation of the jaws 46 of the fixed tube clamp. The movable tube clamp 96 is slidable on the ways 98 and 100 by a pneumatic cylinder 118 mounted on the ways 98 and 100 and having a piston rod 120 fastened to the movable tube clamp. The movable tube clamp is moved against an abutment 122 which is fixed to the second wrapping position.

FIGS. 1 and 2 also illustrate an unloading apparatus for the removal of completely wrapped bundles from the second wrapping position when the jaws 102 are opened. This apparatus comprises a kicker bar 128 which is pivotally supported at 130 on the way 36. When the forward end of the kicker bar 128 is elevated by a pneumatic cylinder 132 with the jaws 102 open, a wrapped bundle will simply roll down the bar 128 into a suitable bundle collecting area (not shown).

From the foregoing it will be apparent that the mechanism of the present invention includes as its principal subassemblies a tube collecting cradle 26, the fixed tube clamp 44, the cutter-wrapper 64 and the movable tube clamp 96. The fixed tube clamp 44 remains in the first wrapping position throughout the sequence of operations. The tube collecting cradle 26 is movable horizontally between a position beneath the chute 12 and the first wrapping position, the movable tube clamp 96 is moved between the second wrapping position (in which it is illustrated in FIGS. 1 and 2) and the first tube wrapping position. The cutter-wrapper assembly is fixed between the wrapping positions although its bar 66 is reciprocable vertically to move the knife 70 and the axis of the pivot pin 74 in a vertical plane midway between the centers of the bundles in the first and second wrapping positions.

FIGS. 7 through 14 illustrate the positions of the various parts of the major subassemblies during the operation of the bundling mechanism.

Figure 9:
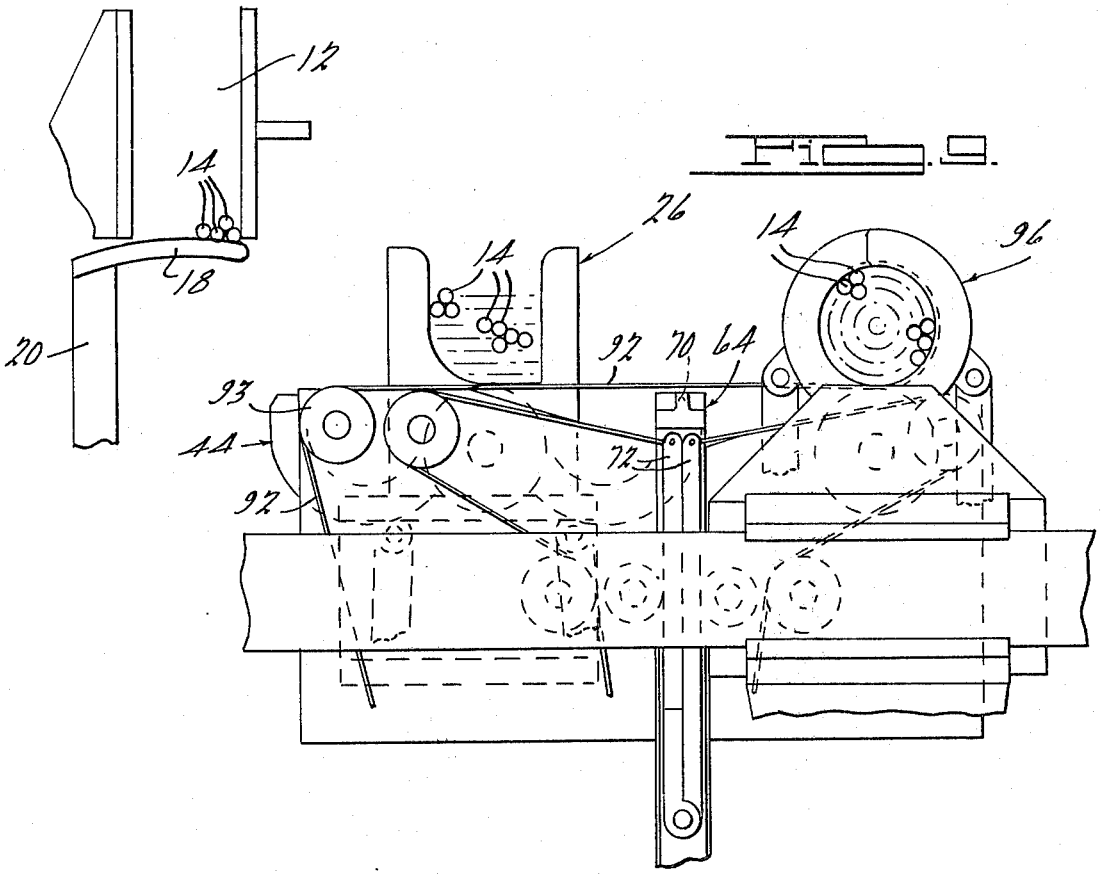
Figure 10:
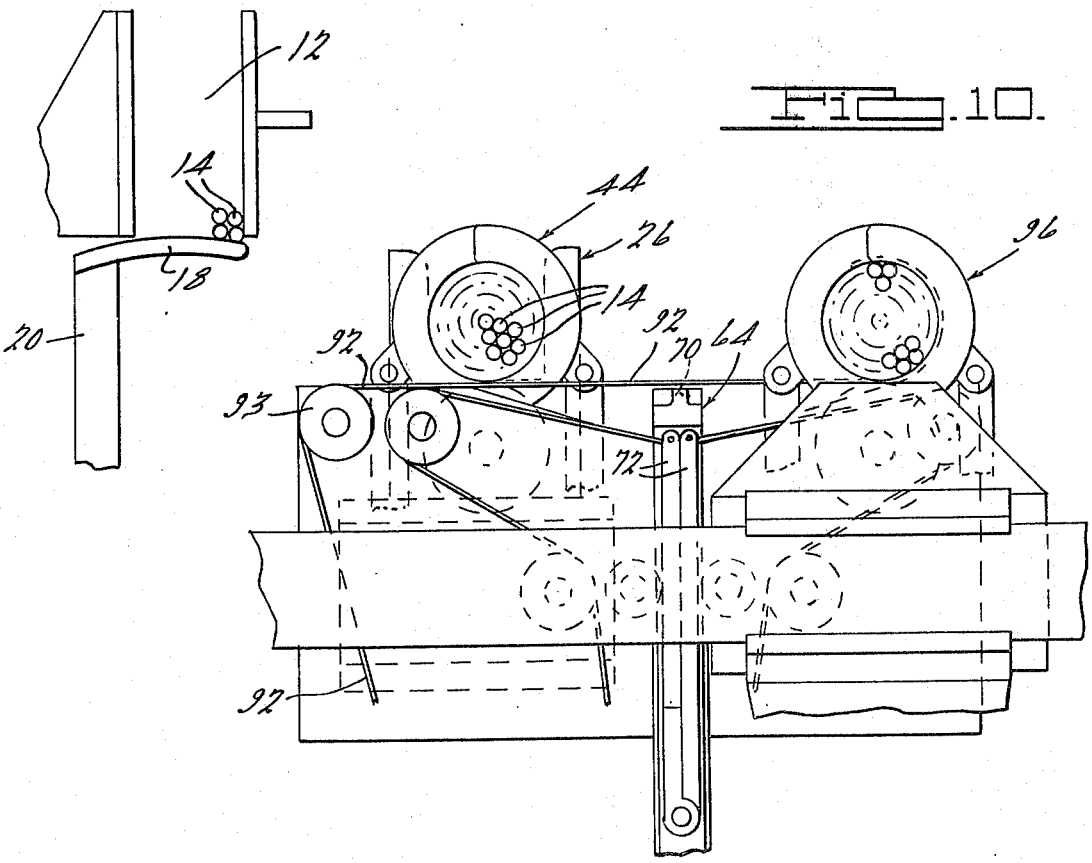

When the mechanism is first started, the end of a length of tape 92 which has been passed around the idler roller 93 is manually wrapped around a bundle in the first work station. Thereafter, however, the free end of the tape 92 will be wrapped around such bundle automatically by the operation of the mechanism. Once the first bundle has been formed and in between the cycling of the mechanism, the various parts of the device will be in the positions illustrated in FIG. 7 waiting for the desired quantity of tubes to be received in the cradle 26. At such times, the gate 18 is open, the cradle 26 is in a retracted position under the chute 12, the jaws 46 of the fixed tube clamp 44 are closed about a bundle of tubes in the first wrapping position, the movable tube clamp 96 is also in the first wrapping position with its jaws 102 closed about the same tube bundle as the jaws 46, and (although not illustrated in FIG. 7) the kicker bar 128 is in its lower position. When the required number of tubes 14 have been deposited in the cradle 26, the mechanism will begin cycling with an initial movement of parts to the positions shown in FIG. 8. That is to say, the gate 18 closes to hold additional tubes in the chute 12 and the jaws 46 of the fixed tube clamp 44 are opened. Next, and as illustrated in FIG. 9, the movable tube clamp 96 moves from the first wrapping position to the second wrapping position. During this movement a fresh length of tape 92 is drawn from its roll and will lie immediately above the knife 70 substantially tangentially to bundles in the first and second wrapping positions. At the same time, the cradle 26 advances from a position beneath the chute 12 to the first wrapping position. As illustrated in FIG. 10, the jaws 46 of the fixed tube clamp 44 then close about the tubes 14 in the first wrapping position.

Figure 11:
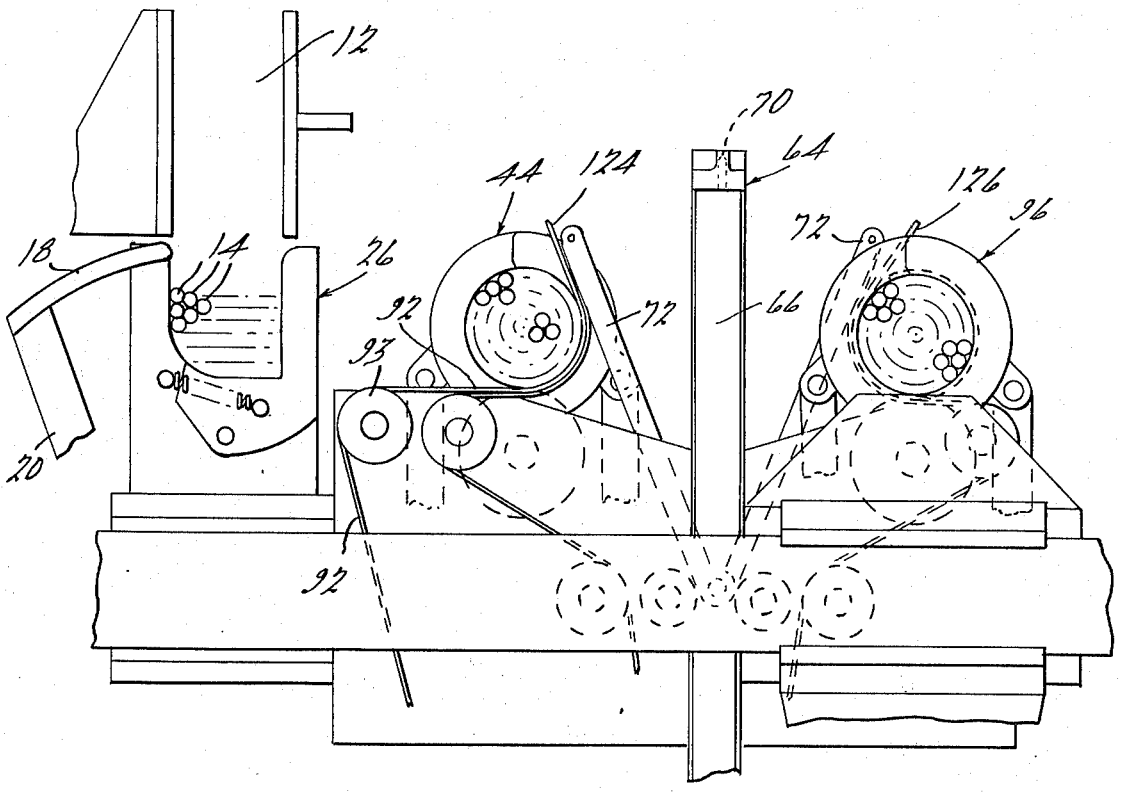

As illustrated in FIG. 11, the cradle 26 then retracts to a position beneath the chute 12 and the gate 18 is reopened. As the cradle 26 retracts its lever 30 opens against the force of the spring 34 (FIG. 1) permitting the lever 30 to ride under the bundle of tubes which is held in the first wrapping position by the jaws 46 of the fixed tube clamp 44. Thus, no special actuating mechanism is needed to open or close the cradle to permit it to be withdrawn from the first wrapping position by its cylinder 40. When the fixed clamp 44 has gripped the tubes in the first work station, the cutter-wrapper mechanism 64 is energized to move the carrier bar 66 upwardly. FIG. 11 shows the cutter-wrapper bar 66 in its partially raised position. The upward movement of the bar 66 first causes the knife 70 to cut the tape 92, leaving cut tape ends 124 and 126. The tape 92 adjacent the cut end 124 is engaged by the strap 76 (which is of a width substantially equal to the width of the tape) and is wrapped by the strap 76 around the bundle in the first wrapping position. Similarly, the strap 76 engages the tape adjacent the cut end 126 to wrap it partially around the tube bundle in the second wrapping position. The adhesive coated sides of the tape 92 are, of course, the sides which engage the tube bundles and not the strap 76. There is no tendency of the tape 92 to stick to the strap 76.

Figure 12:
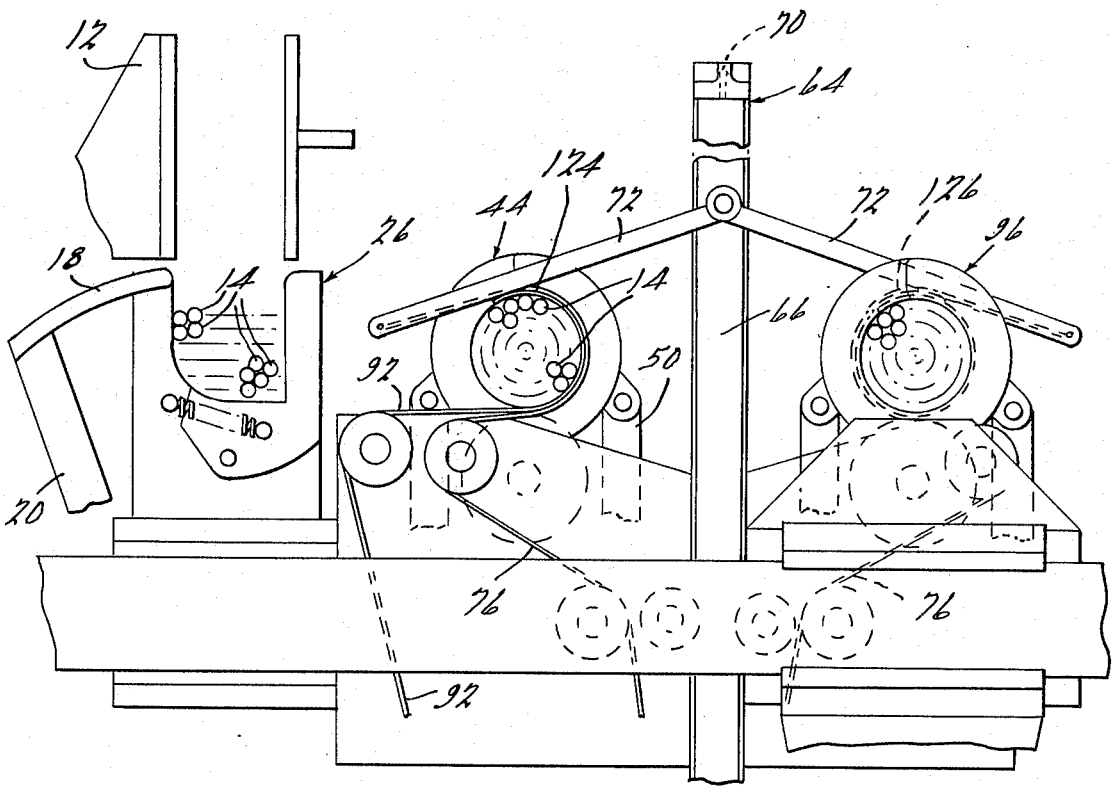

FIG. 12 illustrates the positions of the arms 72 when the bar 66 is in the fully raised position. It will be seen that tape end 124 is wrapped around the bundle in the first wrapping position by an amount slightly more than 180°, that is, from the bottom center of the bundle to a position past the top center. Similarly, the wrap which is made on the bundle in the second wrapping position is slightly greater than 180° causing the cut tape end 126 to be overlapped on the cut tape end 124 produced in the preceding cycling of the cutter-wrapper mechanism. The tape 124, being adhesive backed, is thereby secured not only to the tubes of the bundle but to itself. After the bar 66 has been raised to its full height it is lowered leaving the cut tape ends 124 and 126 adhering to the bundles.

Figure 13:
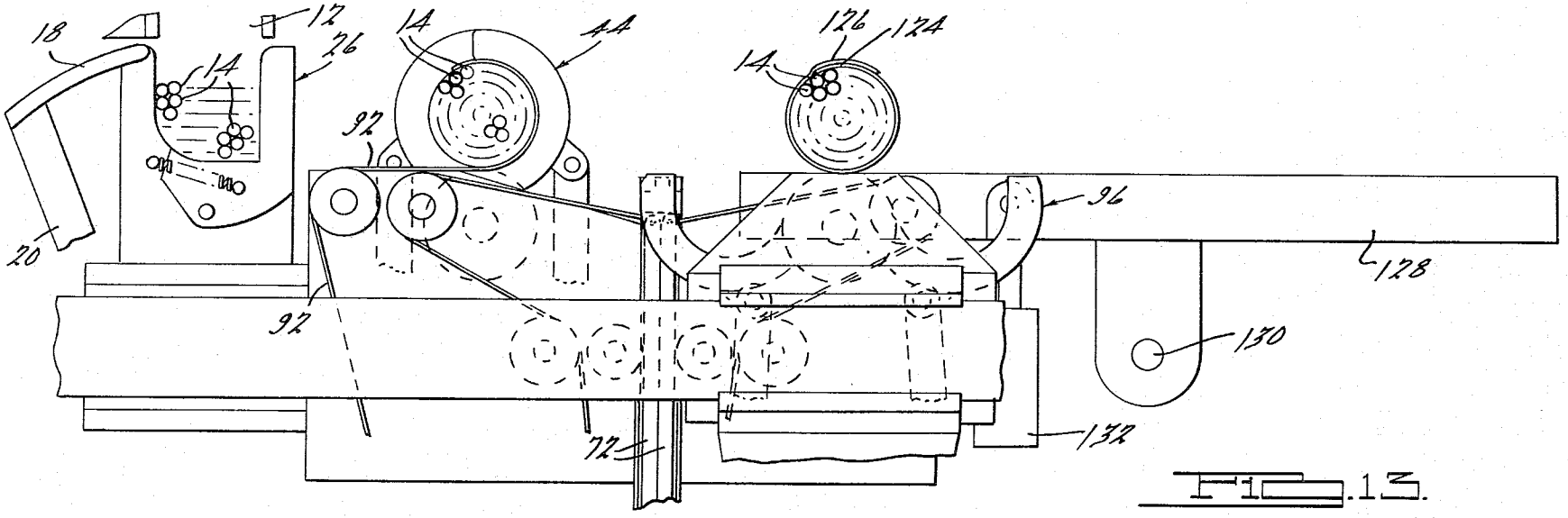
Figure 14:
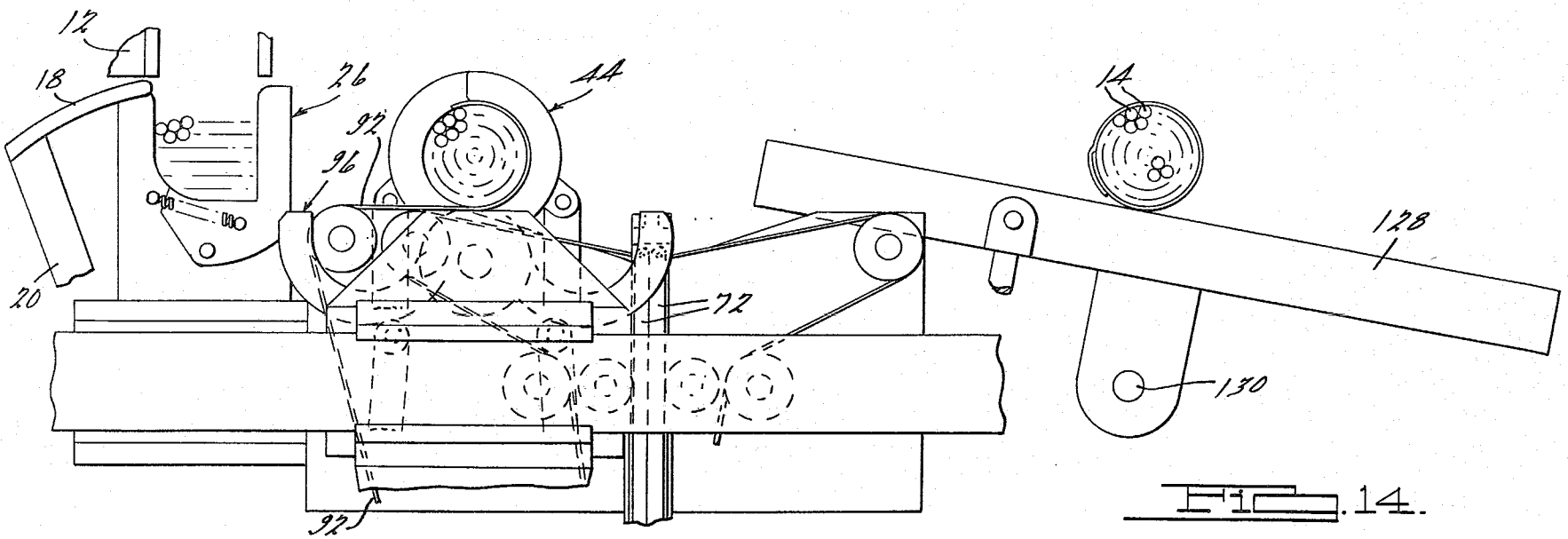

FIG. 13 illustrates the positions of the parts after the bar 66 has been lowered. The jaws of the movable tube clamp 96 are opened to permit the bundle in the second wrapping position to be supported on the kicker bar 128. As illustrated in FIG. 14, the kicker bar 128 is then raised by the cylinder 132 to cause the taped bundle to roll down the kicker bar 128 out of the bundling mechanism. At the same time, the movable tube clamp 96 is retracted from the second wrapping station to the first wrapping station. In so doing its jaws 102 pass beneath the bundle in the first wrapping station. Finally, the parts are returned to the positions illustrated in FIG. 7. That is, the jaws 102 of the movable tube clamp 96 are closed about the bundle in the first wrapping position and the kicker bar 128 is lowered. The parts then remain in this position until the cradle 26 has been filled with an additional quantity of tubes 14 sufficient to form another bundle.

It will be noted that the jaws 102 are arcuately shaped on their inner surfaces so that when they are closed and overlap one another, they define a cylinder of the outer configuration desired for that bundle. It will also be apparent that the act of moving a bundle from the first to the second wrapping stations by the energizing of the cylinder 118 performs the added function of drawing fresh tape from the tape roll 92. The amount of tape which is drawn from the roll during this movement is sufficient to provide the tape necessary for the wrap placed on a bundle. Accordingly, the distance between the centers of the first and second wrapping positions is equal to the circumference of the bundle plus the amount of tape used for overlapping of the tape end 126 onto the tape end 124. The strap 76, being flexible, conforms to the periphery of the bundle and applies the tape 92 with a force sufficient to achieve good adhesion. It will be apparent that one-half of a wrap is applied at each wrapping station. After the first bundle is half-wrapped each cycling of the mechanism will produce a wrapped bundle, although it requires two cyclings of the mechanism to wrap an individual bundle.

While it will be apparent that the preferred embodiment illustrated is well calculated to fulfill the objects above stated, it will be appreciated that the present invention is susceptible to modification, variation and change without departing from the scope of the invention.

What is claimed is:

1. A bundling mechanism including: means operable to support bundles of workpieces in first and second spaced wrapping positions, means operable to move a bundle from said first wrapping position to said second wrapping position, means for supporting a supply of adhesive-backed tape with an end length thereof extending between said wrapping positions peripherally of the bundles at said positions, and tape-wrapper means operable to sever said tape end length from the supply of tape between said wrapping positions and to define a first cut end at the severed end of said end length and a second cut end at the associated resultant end terminating the supply of tape, said tape-wrapper means including means for wrapping said end length and said first cut end around the one of the bundles at said second wrapping position and wrapping said second cut end and tape from the supply of tape partly around the other of the bundles at said first wrapping position whereby each of the bundles is wrapped partly at said first wrapping position and completed with said end length as severed at said second wrapping position.

2. A bundling mechanism including: means operable to support bundles of workpieces in first and second spaced wrapping positions, means operable to move a bundle from said first wrapping position to said second wrapping position, means for supporting a supply of adhesive-backed tape with an end length thereof extending between said wrapping positions peripherally of the bundles at said positions, and a tape cutter-wrapper operable to cut said tape end length between said wrapping positions and wrap the cut ends of said end length around the adjacent portions of the bundles at said first and second wrapping positions whereby a bundle is wrapped partly at said first wrapping position and partly at said second wrapping position, said tape cutter-wrapper including a carrier movable transversely of the tape end length, a pair of arms pivoted on said carrier, means controlling the pivotal movement of said arms as said carrier is moved to cause the ends of said arms to move about the bundles at said first and second wrapping positions, and means associated with said arms engageable with said tape length for pressing the cut ends of said tape end length against bundles at said first and second wrapping positions.

3. The structure set forth in claim 1 wherein the movement of a bundle from said first wrapping position to said second wrapping position serves to draw fresh tape from the tape supply and wherein the distance between said wrapping positions is equal to the length of tape wrapped around a bundle.

4. The structure set forth in claim 2 in which said last-named means includes a flexible strap.

5. The structure set forth in claim 2 in which said last-named means comprises a flexible elongated member having its ends connected to the outer ends of said arms and means for tensioning said member.

6. The structure set forth in claim 1 in which the wrap produced at each of said first and second positions extends more than 180° around the bundle at each of said positions whereby a total wrap of 360° is provided.

7. A bundling mechanism including: means operable to support bundles of workpieces in first and second spaced wrapping position, means operable to move a bundle from said first wrapping position to said second wrapping position, means for supporting a supply of adhesive-backed tape with an end length thereof extending between said wrapping positions peripherally of the bundles at said positions, said means operable to support a bundle of workpieces including a movable workpiece clamp operable to shape and support a bundle of workpieces to be wrapped and being movable between said positions, and tape-wrapper means operable to sever said tape end length from the supply of tape between said wrapping positions and to define a first cut end at the severed end of said end length and a second cut end at the associated resultant end terminating the supply of tape, said wrapper means including means for wrapping said end length and said first cut end around the one of the bundles at said second wrapping position and wrapping said second cut end and tape from the supply of tape partly around the other of the bundles whereby each of the bundles is wrapped partly at said first wrapping position and completed with said end length as severed at said second wrapping position.

8. A bundling mechanism including: means operable to support bundles of workpieces in first and second spaced wrapping positions, means operable to move a bundle from said first wrapping position to said second wrapping position, means for supporting a supply of adhesive-backed tape with an end length thereof extending between said wrapping positions peripherally of the bundles at said positions, said means operable to support a bundle of workpieces including a fixed workpiece clamp operable to shape and support a bundle of workpieces in said first wrapping position and a movable workpiece clamp operable to grip and support a bundle of workpieces at said first wrapping position and being movable between said positions, and means operable to move said movable workpiece clamp from said first wrapping position to said second wrapping position, and tape-wrapper means operable to sever said tape end length from the supply of tape between said wrapping positions and to define a first cut end at the severed end of said end length and a second cut end at the associated resultant end terminating the supply of tape, said tape-wrapper means including means for wrapping said end length and said first cut end around the one of the bundles at said second wrapping position and wrapping said second cut end and tape from the supply of tape partly around the other of the bundles whereby each of the bundles is wrapped partly at said first wrapping position and completed with said end length as severed at said second wrapping position.

9. The structure set forth in claim 1 including means for sequentially receiving workpieces and delivering a predetermined quantity of workpieces to said first wrapping position and a gate operable to block the delivery of workpieces to said receiving means during its delivery operation.

10. An automatic bundling mechanism including bundle supporting means operable to hold a bundle of workpieces in a first wrapping position, a movable bundle clamp for gripping a bundle in said first wrapping position and moving the same to a second wrapping position spaced from said first wrapping position, means for supporting a supply of adhesive backed tape with an end length thereof extending between said first and second wrapping positions peripherally of bundles in said positions, and a tape cutter-wrapper movable transversely of said tape length intermediate said wrapping positions.

said cutter-wrapper being operable to cut said tape end length and wrap portions of said end length on opposite sides of the cut partly around bundles at said first and second wrapping stations whereby the portion of the tape length still connected to the tape supply is adhered to a bundle at said first wrapping station and whereby the movement of a bundle between said station will draw fresh tape from said supply.

11. The structure set forth in claim 10 wherein said cutter-wrapper includes a carrier movable transversely of the tape end length, said carrier supporting a knife operable to cut the tape end length, and wrapping means progressively engageable with the portions of said tape end length on opposite sides of the cut to wrap said portions around the adjacent sides of the bundles at said wrapping positions.

12. The structure set forth in claim 11 in which said wrapping means comprises a pair of arms pivoted to said carrier and outwardly biased flexible means connected to the outer ends of said pivoted arms, said arms being movable outwardly around the bundles at said wrapping positions as said carrier is moved to cause said flexible means to press the tape against the bundles.

13. The structure set forth in claim 10 in which said movable bundle clamp has power-operated jaws movable into and out of gripping relationship with bundles at said first and second wrapping positions.

14. The structure set forth in claim 11 including workpiece collecting means movable into and out of said first wrapping position to deliver a selected quantity of workpieces to said first-named means.

15. The structure set forth in claim 10 in which said bundle supporting means is provided with power-operated bundle gripping jaws operable to grip and release a bundle of workpieces at said first wrapping position.

16. A tube bundling mechanism including:

a cradle operable to receive a plurality of tubes delivered successively thereto, a fixed tube clamp in a first wrapping position having arcuate jaws operable to shape and confine a plurality of tubes to be bundled, means for opening and closing the jaws of said fixed tube clamp.

means for reciprocating said cradle to deliver a selected quantity of workpieces to said fixed tube clamp, a movable tube clamp reciprocal between said first wrapping position and a second wrapping position, said movable clamp having a pair of arcuate jaws operable to grip a bundle of tubes to be wrapped, means for opening and closing the jaws of said movable clamps, means for supporting a supply of adhesive backed tape with an end length thereof extending between the peripheries of the bundles in said first and second wrapping positions, a tape-cutter-wrapper positioned between said wrapping positions and operable to cut said tape length and wrap the cut ends thereof partly around bundles in said first and second wrapping positions, and power-operated means for moving said movable clamp from said first wrapping position to a second wrapping position and thereby draw tape from said tape supply.

* * * * *

UNITED STATES PATENT AND TRADEMARK OFFICE

CERTIFICATE OF CORRECTION

PATENT NO. : 4,003,189

DATED : January 18, 1977

INVENTOR(S) : Keith W. Little and Barry C. Millar

It is certified that error appears in the above-identified patent and that said Letters Patent are hereby corrected as shown below:

Column 3, line 67, "98" should be --96--

Column 8, line 24, "." should be --,--

Column 9, line 2, "." should be --,--

Signed and Sealed this

Fifth Day of April 1977

[SEAL]

*Attest:*

RUTH C. MASON
*Attesting Officer*

C. MARSHALL DANN
*Commissioner of Patents and Trademarks*